US005854647A

United States Patent [19]

Ohtsuka

[11] Patent Number: 5,854,647

[45] Date of Patent: Dec. 29, 1998

[54] TAPE-SHAPED PRINTING MEDIUM AND METHOD OF PRINTING ON TAPE-SHAPED PRINTING MEDIUM BY MEANS OF INK-JET PRINTER

[75] Inventor: Nobutoshi Ohtsuka, Suwa, Japan

[73] Assignee: Seiko Epson Corporation, Tokyo, Japan

[21] Appl. No.: 580,300

[22] Filed: Dec. 28, 1995

[30] Foreign Application Priority Data

Dec. 28, 1994 [JP] Japan ..... 6-326811
Nov. 24, 1995 [JP] Japan ..... 7-306187

[51] Int. Cl.[6] ..... B41J 2/01; B41J 2/175; B41J 5/30

[52] U.S. Cl. ..... 347/101; 347/86; 400/61

[58] Field of Search ..... 347/101, 86; 400/61, 400/63, 109, 83, 62, 76; 346/24, 76 PH; 428/40.1, 42, 40.8, 43, 202; 503/206

[56] References Cited

U.S. PATENT DOCUMENTS 4,737,860 4/1988 Ono et al. ..... 358/298
4,747,619 5/1988 Sager ..... 282/9 R
4,940,690 7/1990 Skees ..... 503/206
5,222,818 6/1993 Akiyama et al. ..... 400/61
5,496,118 3/1996 Ueno et al. ..... 400/61
5,540,507 7/1996 Niwa et al. ..... 400/83
5,587,214 12/1996 Mitchell, Jr. ..... 428/40

*Primary Examiner*—Peter S. Wong
*Assistant Examiner*—Rasnikant B. Patel
*Attorney, Agent, or Firm*—Loeb & Loeb LLP

[57] ABSTRACT

A method is disclosed for conducting solid printing on a tape-shaped recording medium without leaving any unprinted portions on either the sides, leading or trailing ends thereof. A portion of the image-receiving surface of a tape-shaped recording medium of a pre-determined width which is narrower than the full width is used for the actual image-receiving surface, while the other continuous portions are used as dummy image-receiving surfaces. The solid printing action involves solid printing in such a manner that the printing overlaps the edge of the image-receiving surface onto the outer dummy image-receiving surfaces. After solid printing, the center image-receiving surface portion is cut loose from peeling paper, leaving the unnecessary dummy image-receiving surfaces. The image-receiving portion cut loose may be applied to a desired surface, as a piece of printed tape-shaped printing medium solidly printed without unprinted gaps at the edges.

52 Claims, 12 Drawing Sheets

FIG. 5(a)
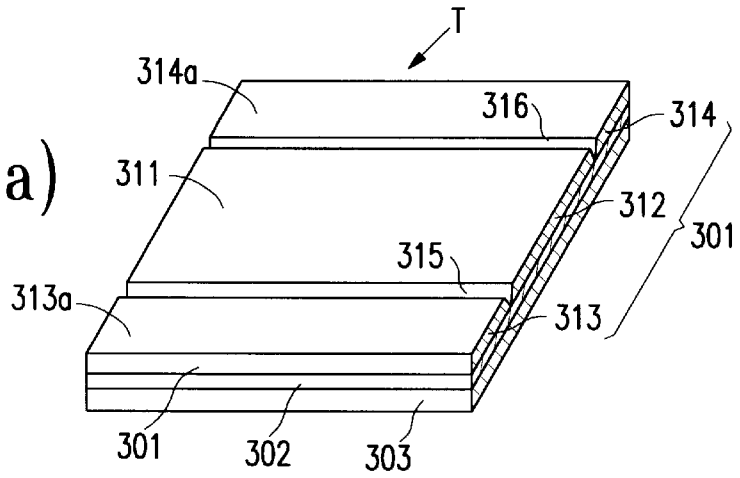
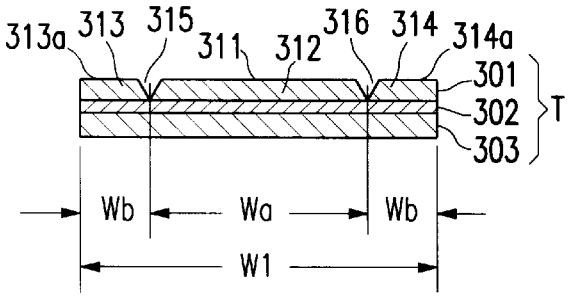
FIG. 5(b)
FIG. 5(c)
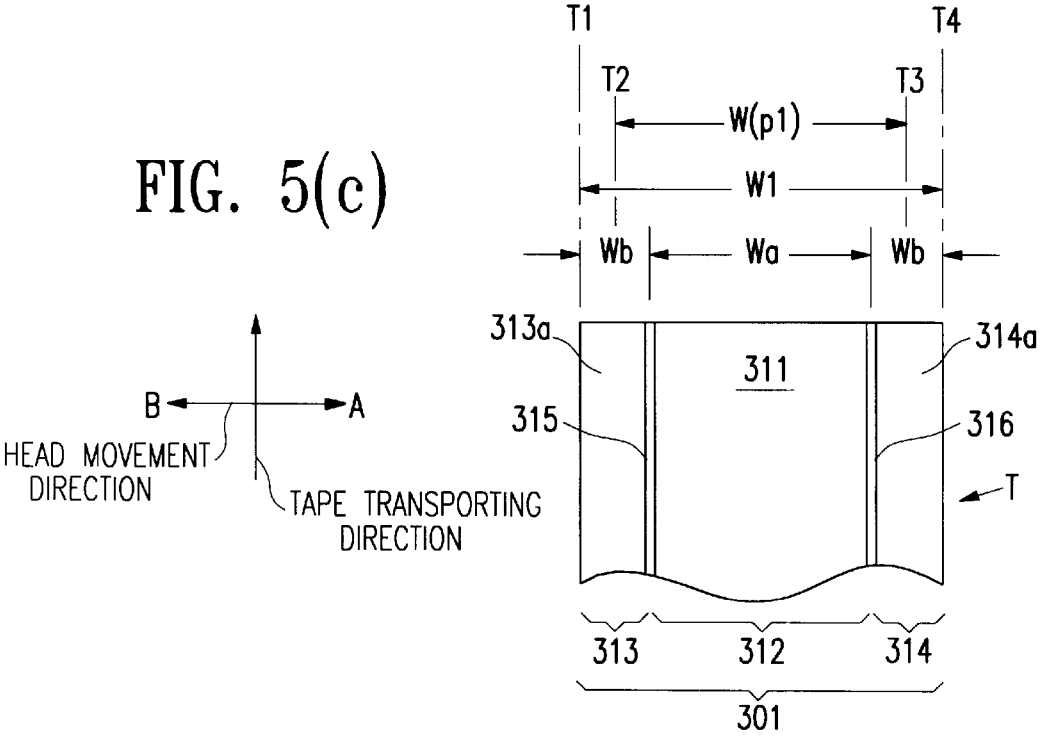

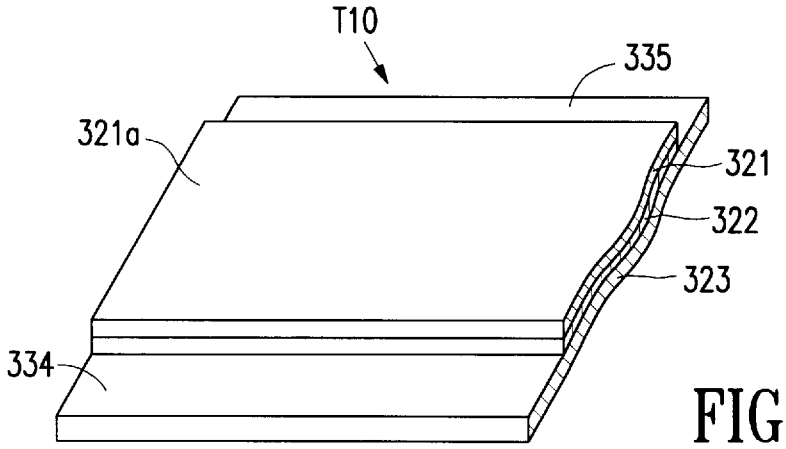
FIG. 7(a)
FIG. 7(b)
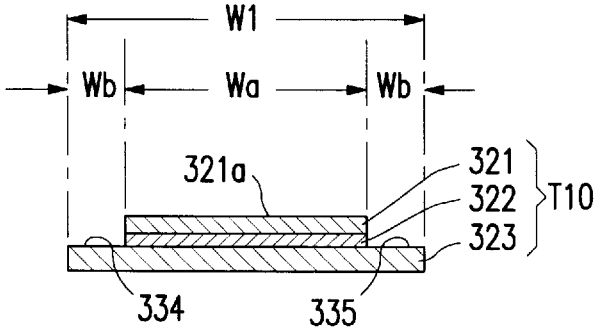
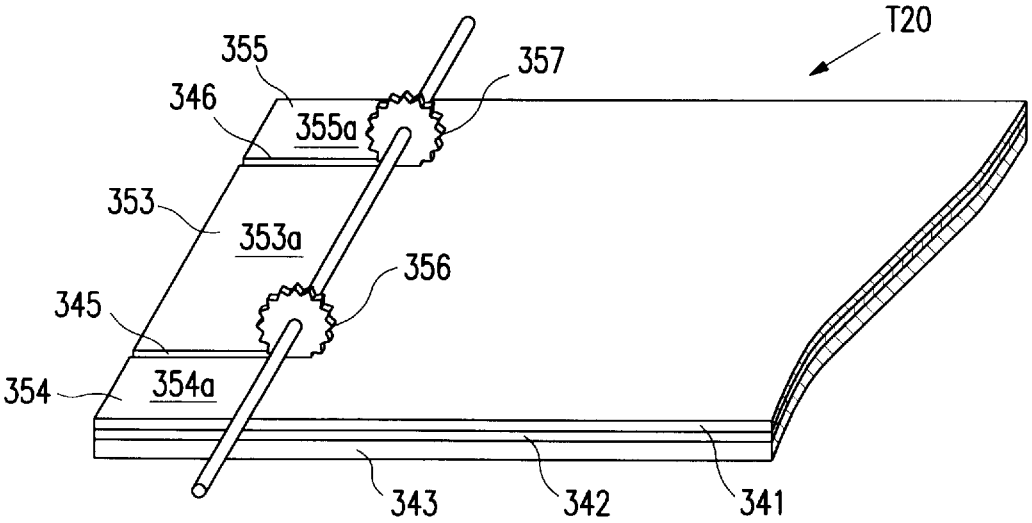
FIG. 8

MODE SETTING FOR NEXT PRINTING STARTING

| MODE OF PREVIOUS PRINTING FINISHING | M1 ($X_1$) | M2 ($X_2$) | M3 ($X_3$) |
|---|---|---|---|
| M1 ($X_1$) | $Y_1 - X_1 + X_{10}$ | $Y_1 - X_1 + X_{10}$ | $Y_1 - X_1 + X_{10}$ |
| M2 ($X_2$) | $Y_1 - X_2 + X_{10}$ | $Y_1 - X_2 + X_{20}$ | $Y_1 - X_2 + X_{20}$ |
| M3 ($X_3$) | $Y_1 - X_3 + X_{10}$ | $Y_1 - X_3 + X_{20}$ | $Y_1 - X_3 + X_{30}$ |

TAPE-SHAPED PRINTING MEDIUM AND METHOD OF PRINTING ON TAPE-SHAPED PRINTING MEDIUM BY MEANS OF INK-JET PRINTER

FIELD OF THE INVENTION

The present invention relates to a printing method which employs an ink-jet print head to conduct solid printing essentially without gaps upon a tape-shaped printing medium of a certain width.

The present invention also relates to a tape-shaped printing medium appropriate for such solid printing.

BACKGROUND AND SUMMARY OF THE INVENTION

There are various types of ink-jet printers known, and among such are small-scale printers configured to conduct color printing upon tape-shaped printing mediums of various configurations. Small-scale ink-jet printers of this type are enabled to conduct color printing upon tape-shaped printing mediums by means of providing to the print head ink from ink reservoirs of the colors cyan (C), magenta (M), and yellow (Y).

As for tape-shaped printing mediums, there are such which include an adhesive layer covered with peeling paper on the reverse face thereof, and by cutting the tape-shaped printing medium into a certain length following printing and then removing the peeling paper, enables usage as a label which can be applied to a desired surface. Printers which conduct printing on such tape-shaped printing mediums are referred to as "label printers" or "label word processors," and have been on the market in recent years.

The following problems occur when employing an ink-jet printer to

The following problems occur when employing an ink-jet printer to conduct solid printing which completely colors in the tape-shaped printing medium without gaps.

First, in the case that the print head is to be moved in a reciprocating motion in the width direction of the tape, this means that printing is to be conducted fully from edge to edge of the width direction of the tape. However, it is difficult to accurately conduct printing by driving the print head in accordance with the edges of the tape. As a result, for example, if the initiation of the printing action falls behind the timing at which the print head is positioned at the edge of the tape, unprinted portions remain on the edge of the tape. On the other hand, if the initiation of the printing action is ahead of the timing at which the print head is positioned at the edge of the tape, ink droplets emitted from the print head adhere to the paper guide which is positioned opposite of the print head. Ink drops adhering to the paper guide is problematic, as paper transported over such becomes soiled with ink droplets.

Further, it is difficult to conduct printing on the tape-shaped printing medium without leaving gaps at the leading or trailing edges thereof. In other words, it is just as difficult to conduct printing with the print head in accordance with the leading end of the tape-shaped printing medium, as with the above case of conducting solid printing over the full width of the tape-shaped printing medium, and similar problems occur. Furthermore, if the tape-shaped printing medium is to be cut to a predetermined length following printing to enable use, attempts to conduct solid printing which would completely cover the trailing end of the cut tape-shaped printing medium would require precise transporting of the tape-shaped printing medium and driving of the print head. Further, the cutting position would also need to be accurately controlled.

The object of the present invention then, in light of the above, is to provide a printing method which can solidly print both edges of a recording medium without leaving any unprinted portions on the lateral sides thereof and without emitted ink droplets adhering to the paper guide, thereby soiling the recording medium.

Another object of the present invention is to provide a printing method which can solidly print a recording medium which is cut following printing, without leaving any unprinted portions on either the leading or trailing ends thereof.

Further, another object of the present invention is to provide a tape-shaped recording medium which is appropriate for achieving the above objects.

BRIEF DESCRIPTION OF THE DRAWINGS

FIG. 5 is a diagram illustrating one example of the tape-shaped printing medium: (a) is a partial sketch, (b) is a cross-sectional drawing, and (c) is a partial plan view drawing.

FIG. 7 is a diagram illustrating another example of the tape-shaped printing medium: (a) is a partial sketch, and (b) is a cross-sectional drawing.

FIG. 8 is an explanatory diagram illustrating the mechanism for cutting both ends of the tape-shaped printing medium.

DETAILED DESCRIPTION OF THE PREFERRED EMBODIMENTS

Figure 1:
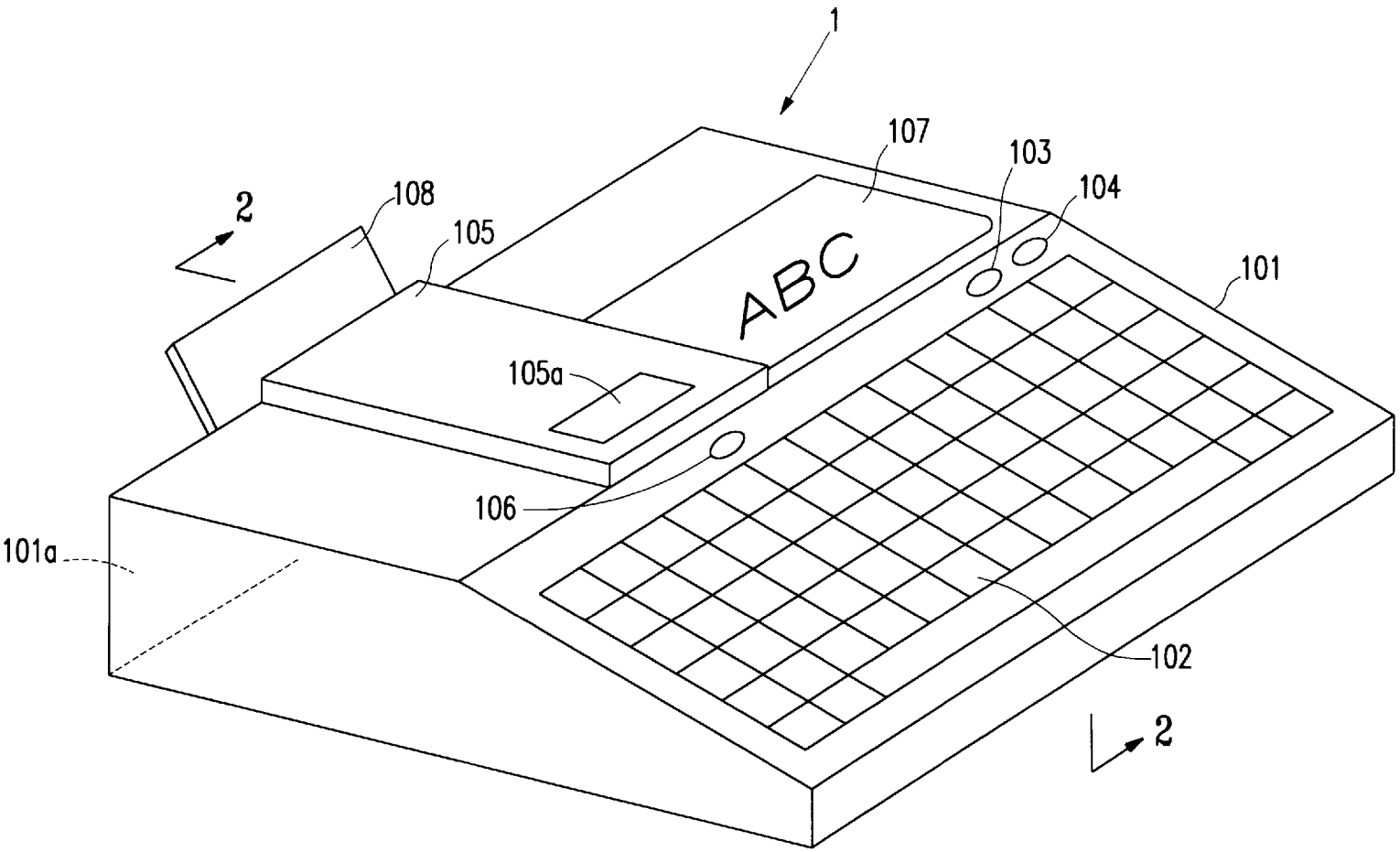
FIG. 1 is a sketch drawing of an ink-jet printer employing the present invention.

In order to solve the problems mentioned above, the present invention uses the image-receiving surface of a tape-shaped recording medium of a pre-determined width, a portion thereof which is narrower than the full width is used for the actual image-receiving surface, while other portions are used as dummy image-receiving surface. The solid printing action involves solid printing in such a manner that the printing overlaps from the edge of this narrower image-receiving surface onto the outer dummy image-receiving surface portion. After solid printing, the unnecessary dummy image-receiving surface portion is cut loose, thereby obtaining a piece of printed tape-shaped printing medium solidly printed in the longitudinal direction without unprinted gaps at the edges.

The method according to the present invention of solid printing upon a tape-shaped printing medium is comprised of:

providing a tape-shaped printing medium constructed of an image-receiving surface of a certain width and a dummy image-receiving surface formed on at least one side of said image-receiving surface;

transporting the tape-shaped printing medium along a transport path through the printing position for an ink-jet printing head;

conducting solid printing onto the tape-shaped printing medium which passes through said printing position in such a manner that the solid printing overlaps the edge of the said image-receiving surface onto the neighboring dummy image-receiving surface, thereby solidly printing the edge portion of said image-receiving surface neighboring said dummy image-receiving surface; and cutting the tape-shaped printing medium of which printing has been completed in the longitudinal direction along the boundary line between said image-receiving surface and said dummy image-receiving surface, thereby obtaining a printed tape-shaped printing medium solidly printed without gaps at least at the edge portion of said dummy image-receiving surface.

The tape-shaped printing medium employed with the present invention may be of a construction wherein the surface thereof is comprised of an image-receiving surface and dummy image-receiving surface. An adhesive layer is formed on the reverse face of the image-receiving layer, and a peeling paper layer covers the adhesive layer. Using such a tape-shaped printing medium enables post-printing removal of the peeling paper so that the medium can be applied to a desired surface.

The border between the image-receiving surface and the dummy image-receiving surface may be provided with a slit formation. This enables removal of the image-receiving portion on which an image receiving surface has been formed following solid printing from the portions on either one or both sides comprising dummy image-receiving surfaces, without usage of a cutting blade for the removal action. Further, the image-receiving layer portion alone can be peeled away from the peeling paper side, by simply catching with one's fingertips the image-receiving portion upon which the image-receiving surface is formed.

The dummy image-receiving surface may be cut away from the image-receiving surface, by means of cutting the tape-shaped printing medium employing a cutting blade, instead of forming such slits. For example, a cutting blade may be provided downstream from the ink-jet head, and the tape-shaped printing medium may be cut employing this cutting blade.

Further, it is desirable to have marks formed upon the dummy image-receiving surface in the longitudinal direction of the tape-shaped printing medium. This allows for the user to cut and remove the tape-shaped printing medium after printing in an accurate manner. The marks may be formed on the tape-shaped printing medium beforehand by means such as printing, or may be printed thereupon as necessary by using the ink-jet print head.

As for the tape-shaped printing medium, rather than employing such as the aforementioned in which the image-receiving layer itself is wide, a printing medium possessing an image-receiving layer which is made to be an image-receiving surface with an adhesive layer formed on the reverse face of the image-receiving layer, and a peeling paper covering the adhesive layer, wherein the face of the peeling paper which faces the adhesive layer is provided with an exposed surface whereupon there is no deposition of the image-receiving layer nor the adhesive layer can be employed. In this configuration, the exposed surface comprises the dummy image-receiving surface.

The present invention further relates to a method of printing upon a tape-shaped printing medium, which is cut to a predetermined length, thereby obtaining a piece of printed tape-shaped printing medium of a certain length, wherein solid printing can be conducted so as to not leave unprinted portions on the leading and trailing ends thereof. To this end, the present invention conducts solid printing from a point before the cutting position, or to a point beyond the cutting position, then cuts the unnecessary leading and trailing solid print portions, thereby obtaining a solidly printed tape-shaped printing medium formed by cutting without unprinted portions at the leading and trailing ends.

The method according to the present invention of solid printing upon a tape-shaped printing medium is comprised of:

providing a tape-shaped printing medium constructed of an image-receiving surface of a certain width;

transporting the tape-shaped printing medium along a transport path through the printing position for an ink-jet printing head;

conducting solid printing of a predetermined length onto the tape-shaped printing medium which passes through the printing position; and cutting the tape-shaped printing medium of which printing has been completed in the width direction either upstream from the printing starting position or downstream on the transporting direction from the printing finishing position, thereby obtaining a piece of printed tape-shaped printing medium of a certain length solidly printed without gaps at the cut portion.

The mechanism to cut the tape-shaped printing medium following printing is generally provided downstream of the printing position. In this case, the tape-shaped printing medium is temporarily stopped and cut after the solid printing starting position has passed through the cutting position. By controlling the position the tape-shaped printing medium is stopped, an effect can be obtained wherein the solid printing width in the longitudinal direction of the tape-shaped printing medium at the starting edge portion of the obtained solid printing can be adjusted.

Similarly, by stopping and cutting the tape-shaped printing medium before the solid printing finishing position passes through the cutting position, an effect can be obtained wherein the solid printing width in the longitudinal direction of the tape-shaped printing medium at the finishing edge portion of the obtained solid printing can be adjusted.

In the method of the present invention, the solid printing portions of the leading and trailing ends are cut so as to obtain solid printing without unprinted portions on the leading and trailing ends. As a result, the portion of tape-shaped printing medium used increases for the amount of solid printing which is cut loose. In cases where solid printing is conducted consecutively, the amount of tape-shaped printing medium which is wasted increases. In order to decrease the amount of such wasted tape-shaped printing medium, the tape-shaped printing medium is moved backwards following a solid printing action, and the printing position is positioned within the solid printing portion remaining from the previous solid printing at the leading end of said tape-shaped printing medium. Following this, the second solid printing action is started. As a result, the solid printing portion remaining from the first solid printing and the solid printing portion of the second solid printing overlap. Consequently, that much tape-shaped printing medium can be saved from going to waste. Further, by adjusting the printing starting position of the second solid printing according to the printing width of the first solid printing, even more tape can be saved from going to waste.

The present invention also relates to a tape-shaped printing medium which is appropriate for use with the above printing method on a tape-shaped printing medium. The first form of the tape-shaped printing medium according to the present invention is a tape-shaped printing medium with an image-receiving surface of a certain width and a dummy image-receiving surface of a predetermined width formed on at least one side of the image-receiving surface, comprising:

an image receiving layer of the image-receiving surface and the dummy image-receiving surface;

an adhesive layer formed on the reverse face of the image-receiving layer; and a peeling paper layer covering the adhesive layer.

Generally, dummy image-receiving surfaces are formed on either side of the image-receiving surface. The tape-shaped printing medium may also be configured so that the border between the image-receiving surface and the dummy image-receiving surface is provided with a slit formation, making for easy removal of the image-receiving surface portion alone.

Also, since the tape-shaped printing medium is to be cut following printing, it is desirable to have marks formed at predetermined intervals upon the dummy image-receiving surface of the tape-shaped printing medium. This allows the user to cut the tape-shaped printing medium in an accurate manner after printing.

A second form of the tape-shaped printing medium according to the present invention is a tape-shaped printing medium with an image-receiving surface of a certain width and a dummy image-receiving surface of a predetermined width formed on at least one side of the image-receiving surface comprising:

an image-receiving layer which is made to be an image-receiving surface;

an adhesive layer formed on the reverse face of the image-receiving layer; and a peeling paper covering the adhesive layer wherein the face of the peeling paper which faces the adhesive layer is provided with an exposed surface whereupon there is no deposition of the image-receiving layer nor the adhesive layer, the exposed surface comprising the dummy image-receiving surface.

In this case as well, it is desirable to have marks formed at predetermined intervals upon the dummy image-receiving surface in the longitudinal direction of the tape-shaped printing medium.

When conducting solid printing on a tape-shaped printing medium so as to leave no gaps on either end, solid printing is conducted with an ink-jet print head onto the image-receiving surface on the surface of the tape-shaped printing medium and on the dummy image-receiving surface as well, in a continuous manner. By first conducting printing onto the dummy image-receiving surface in a bled manner and then cutting the dummy image-receiving surface portion, a tape-shaped printing medium comprised of an image-receiving surface carrying solid printing without unprinted portions on either the right or left side can be obtained.

Further, when cutting tape-shaped printing medium to a predetermined length following printing, thereby obtaining a piece of printed tape-shaped printing medium of a certain length, if solid printing is to be conducted so as not to leave unprinted portions on the leading and trailing ends thereof, the tape-shaped printing medium is cut after the point where the starting edge of solid printing passes through the printing position, and the tape-shaped printing medium is cut before the point where the finishing edge of solid printing passes through the printing position. As a result, the leading and trailing ends of the obtained tape-shaped printing medium are within the solid printing region which is printed without gaps. Consequently, a piece of tape-shaped printing medium comprised of an image-receiving surface carrying solid printing without unprinted portions on either the leading or trailing end can be obtained.

Furthermore, with the tape-shaped printing medium of the present invention, the dummy image-receiving surface portion on either one side or both sides thereof can be easily cut loose from the center image-receiving portion. Further, with such having marks formed on the dummy image-receiving surface, the user can cut the printed tape-shaped printing medium according to the marks in an accurate manner.

Figure 2:
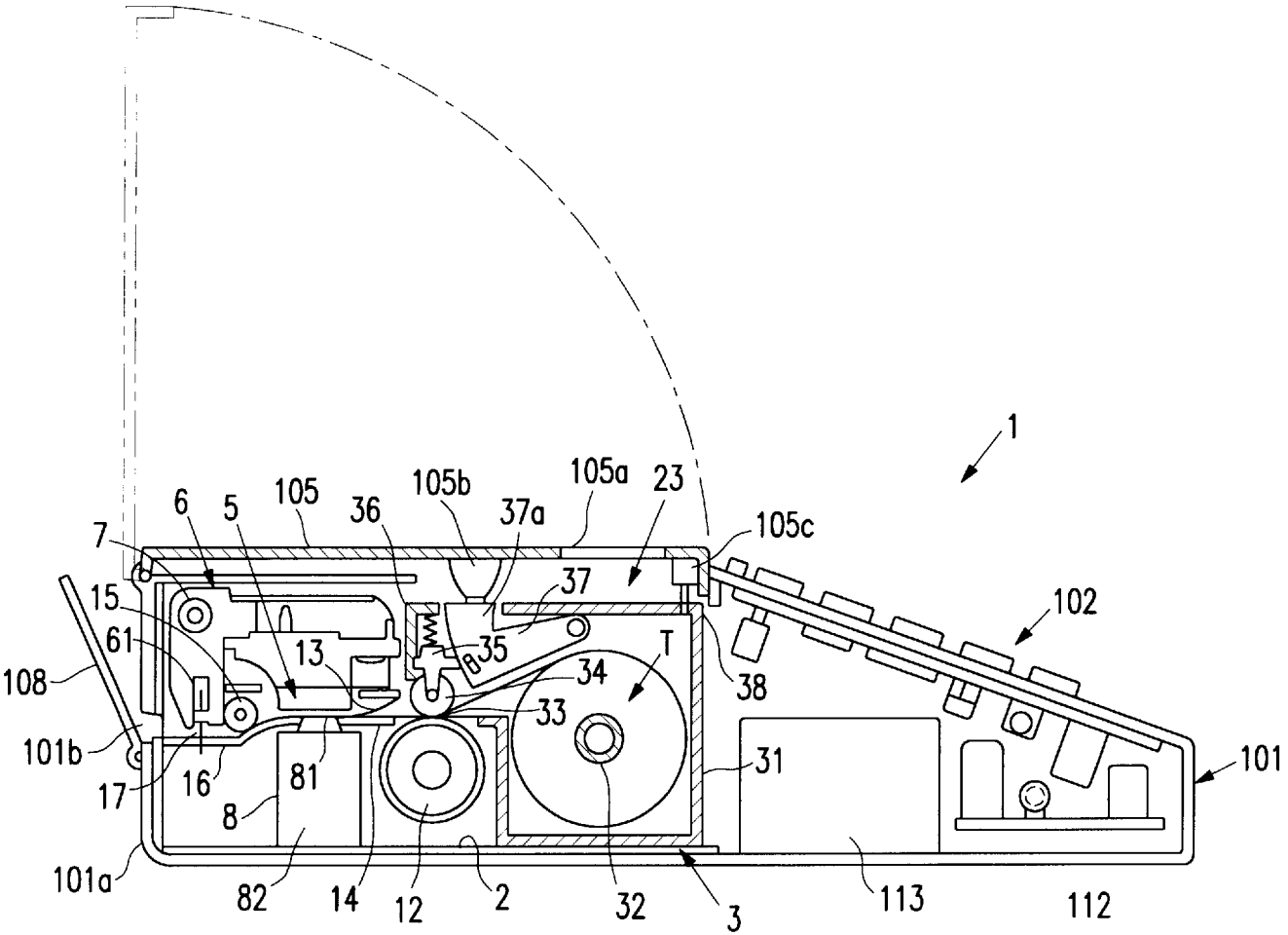
FIG. 2 is a schematic cross-view drawing of the printer of FIG. 1 cut along line 2—2.

The following is a description of embodiments of the present invention, with reference to the drawings. FIG. 1 is a sketch drawing of an ink-jet printer employing the present invention and FIG. 2 is a schematic cross-view drawing of the portion cut along line 2—2. The ink-jet printer of this embodiment is of the type called "label printer" or "label word processor", and conducts printing on the front of a tape-shaped printing medium provided with an adhesive layer on the rear face thereof, the adhesive layer being covered with peeling paper (this tape-shaped printing medium hereafter referred to simply as "tape").

Description will now be given with reference to FIG. 1 and FIG. 2. The ink-jet printer 1 has rectangular casing 101 which is thin as a whole and the upper front half thereof forms the operation panel 102. Various keys are provided thereupon including print button 103 which commands printing action and power source button 104. Attached to the rear side of the casing 101 is a lid 105. Lid 105 can be opened and closed by revolving on the rear edge thereof and the lock thereof can be released by means of operating the lid open/close button 106 arrayed on the operation panel 102, so as to open the lid 105.

Opening lid 105 reveals the mounting portion 23 for later-mentioned tape cartridge 3. This means that opening the lid 105 enables mounting and removal of the tape cartridge 3. A transparent window 105*a* is provided on the lid 105 and via window 105*a* confirmation can be made of whether the tape cartridge 3 is mounted or not. In the position neighboring lid 105 is a liquid crystal display unit 107 for displaying the character information input from the keys of the operation panel 102. On the reverse side 101*a* of the casing 101 is formed a tape ejection aperture 101*b* through which the tape after printing is ejected. The tape being ejected from here is guided by means of a tape ejecting guide plate 108. Further, within the casing 101 behind the operation panel 102 are located a power source unit 112 and batteries 113 such as nickel-cadmium batteries.

Figure 3:
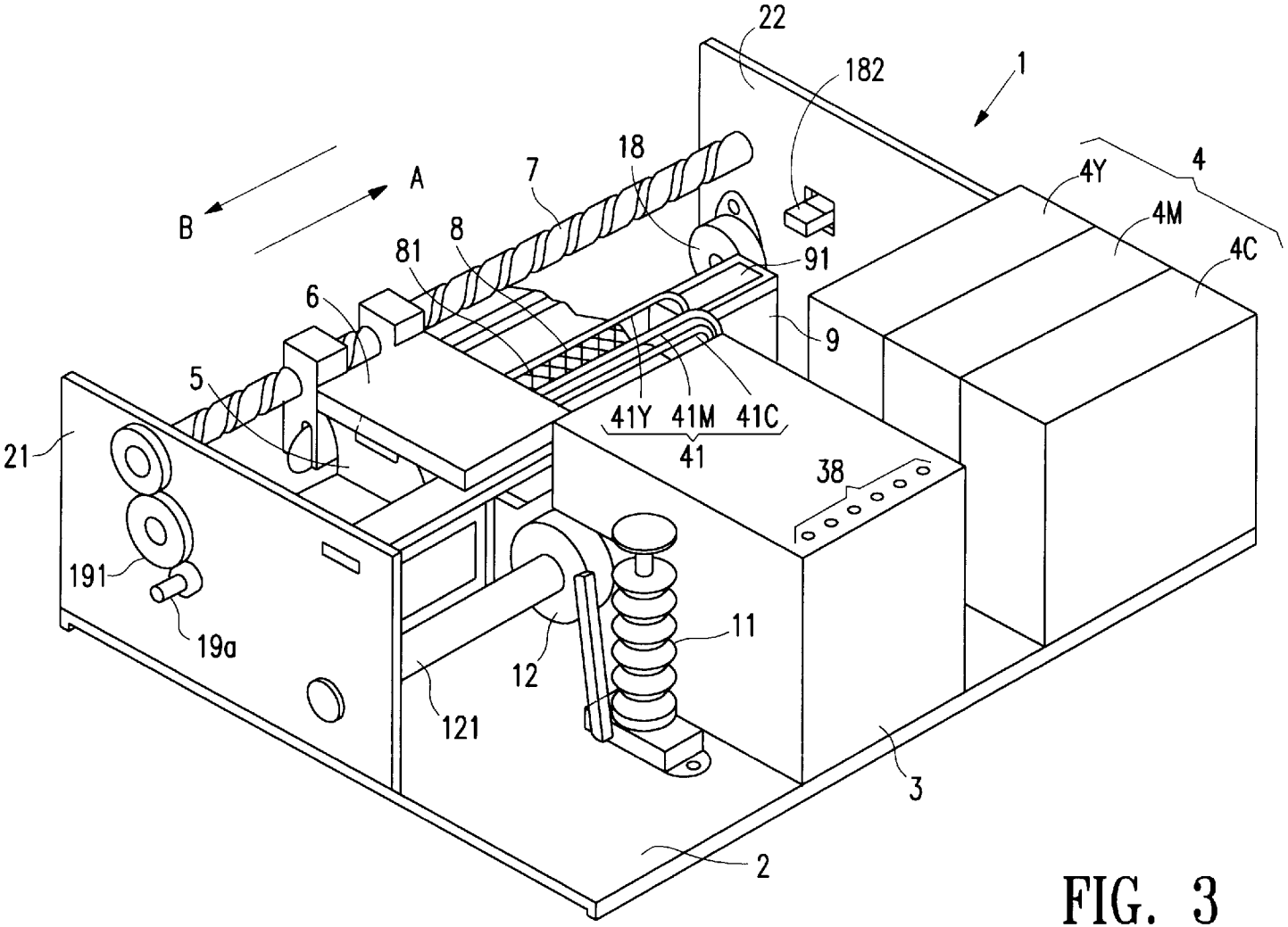
FIG. 3 is a schematic configuration of the main portion of the ink-jet printer of FIG. 1.

Next, FIG. 3 illustrates a schematic configuration of the main portion of the ink-jet printer 1 provided within the casing 101. In the Figure, base 2 is provided for mounting the various members and is formed of the bottom of the casing 101. Upon base 2 is situated the tape cartridge 3, three ink reservoirs 4 (4C, 4M, 4Y), and the ink-jet type print head 5. The print head 5 is carried by a head carriage 6 and the head carriage 6 is supported by a lead screw 7 which extends from the right and left walls 21 and 22 of the base 2. The carriage 6 is supported by means of a guide shaft (not shown) which is parallel to the lead screw 7 so as to freely move horizontally but not rotate. As a result, the head carriage 6 and the print head 5 carried thereupon can be horizontally moved in a reciprocating manner by means of rotating the lead screw 7. At the center of the movement range of the print head 5 is disposed a paper guide 8 so as to oppose the print head 5.

There is a head cap mechanism 9 disposed against the paper guide 8 at the side of the side wall 22, so that the print head 5 is maintained in a sealed condition by the cap surface 91 of the cap mechanism 9. On the side of the tape cartridge 3 is disposed an ink pump 11 for forcibly providing ink from the ink reservoirs 4 to the ink head 5 by manual means.

Figure 4:
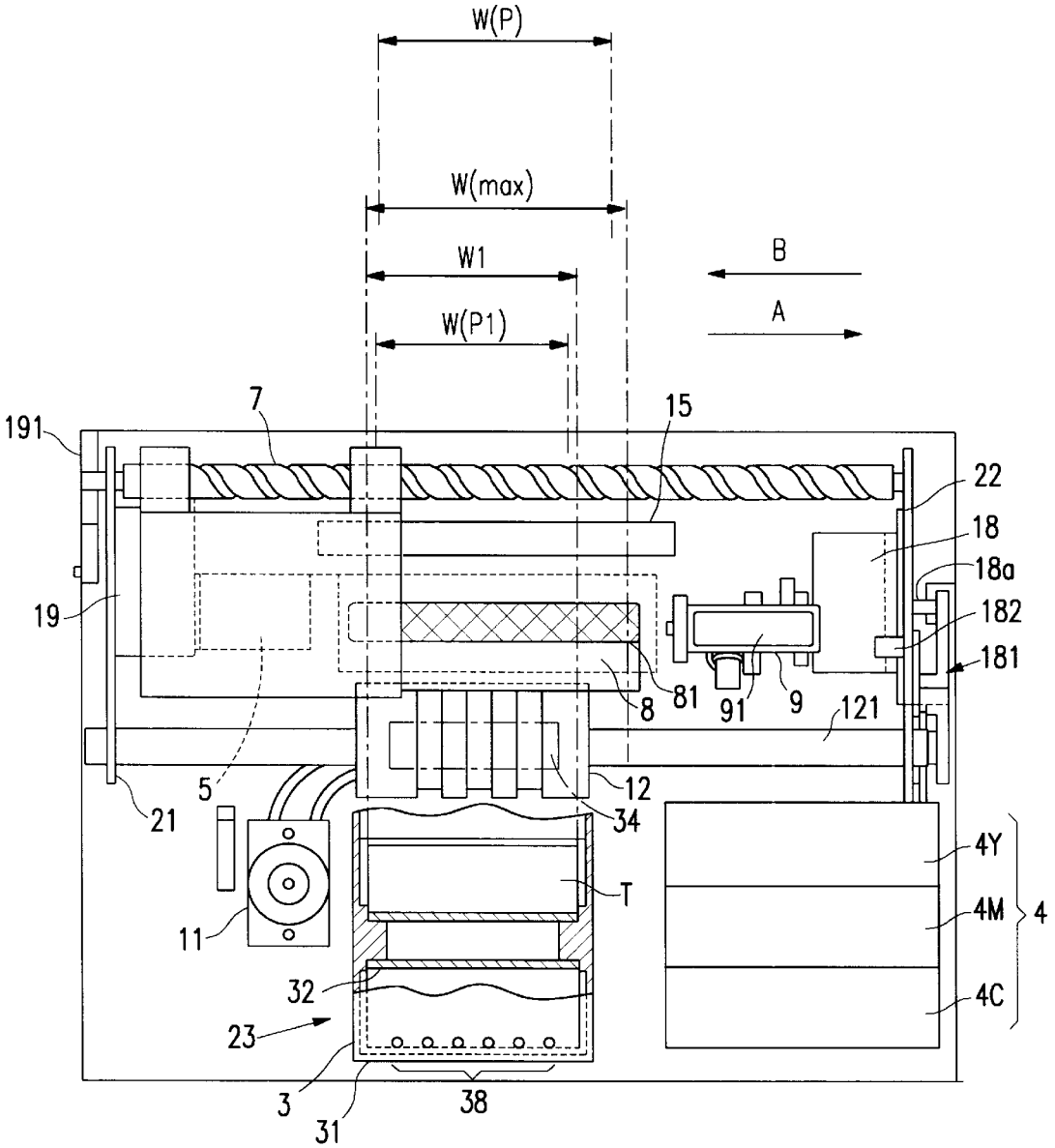
FIG. 4 is a schematic configuration of the main portion of the ink-jet printer which is illustrated in FIG. 4, from an overhead view.

Next, FIG. 4 shows the placement configuration of the main portion of the ink-jet printer 1 which is illustrated in FIG. 3 from an overhead view. Detailed description of the configuration of the main portion of the ink-jet printer 1 of the present embodiment will be given with reference to this drawing as well.

The tape cartridge 3 is comprised of a case 31 of a certain thickness, a shaft 32 contained therein in a freely rotating manner, and tape T of a certain width W1 which is wound around the shaft 32. The upper portion of the front side of the case 31 protrudes forward, and at this portion is formed a tape-feeding portion which is comprised of a tape guide 33 formed of PET film and a tape depressing roller 34 pressed thereupon with a certain amount of elasticity. The leading end of the tape T is initially set so as to be pinched therebetween. The supporting member 35 of the tape depressing roller 34 is supported by the side of case 31 by means of a coil spring 36 in a state of being vertically movable as opposed to the tape guide 33. Further, the supporting member 35 is linked to a lever 37. The lever 37 possesses a protruding surface 37*a* which protrudes out from the upper surface of the case 31. Depressing the protruding surface 37*a* causes the tape depressing roller 34 to be pressed against the side of the tape guide 33 in an interlocking manner. Further, six display units 38 are formed upon the upper surface of the case 31 to display the width dimensions of the tape T contained within.

On the side of the ink-jet printer, to which the tape cartridge 3 of the above construction is mounted in a removable fashion, is formed a mounting portion 23 for mounting the tape cartridge 3. In the mounting portion 23, a tape feeding roller 12 is provided directly below the tape guide 33 which defines the tape delivery portion of the tape cartridge 3. The roller 12 has a configuration of large diameter and small diameter portions formed alternately. Further, as described earlier, directly above the tape cartridge 3 is attached a lid 105 for removing the tape cartridge 3 as opposed to the mounting portion 23.

As can be seen from FIG. 2, a depressor portion 105*b* is formed on the lid 105 so that closing the lid can depress the protruding surface 37*a* of the lever 37 which protrudes out from the upper surface of the case. Further, upon the lid 105 which opposes the display units 38 formed upon the upper surface of the case of the tape cartridge 3 to display the width dimensions of the tape contained within, is formed a detecting unit 105*c* for the detection thereof.

Next will be described the transport path of the tape T which is delivered from the tape cartridge 3. The tape T is delivered by means of the roller 12 rotating. Multiple tape guide pieces 13 formed of PET film are disposed in a state of coming into contact with the perimeter of the smaller diameter portion of the tape feeding roller 12. The leading end of the tape T is accurately guided toward the progressive transport direction by means of these tape guide pieces 13. A stainless steel tape guide 14 is disposed beyond these tape guide pieces 13 in the transporting direction. The tape T is guided toward the printing direction by means of the guide 14 and a guide 15 disposed opposing the guide 14. The printing position is defined by the print head 5 and paper guide 8 disposed opposing the print head 5. The tape T which passes through the printing position is pressed against the side of the tape guide 16 by means of the tape depressing roller 15, thereby passing through the tape cutting position 17, and being transported out from the tape ejecting aperture 101*b*.

The drive transmission system for the aforementioned tape feeding roller 12 and head carriage 6 which carries the print head 5 will now be described. As shown in FIGS. 3 and 4, a tape feeding motor 18 is attached on the inner side of the side wall 22 of the base 2. The motor output shaft 18*a* is linked to an end of the rotating shaft 121 of the tape feeding roller 12 via gear train 181. In the present embodiment, the gear train 181 is provided with a drive switching function and configured so that when the head carriage 6 moves to the side of the side wall 22 and presses the projection 182 projecting therefrom to the interior, the drive transmission path is switched, and the drive of the motor 18 is transmitted to the side of the cap mechanism 9.

Further, a head drive motor 19 is provided at the inside of the other side wall 21 above the base. The motor output shaft 19*a* is linked to an end of the lead screw 7 via a braking mechanism 191 comprised of the gear train.

The ink supply system is basically comprised of ink reservoirs 4, three ink tubes 41 (41Y, 41M, 41C) for supplying ink therefrom to the print head 5 and an ink pump 11 for forcibly supplying by manual means. Within the three ink reservoirs 4C, 4M, and 4Y, are respectively stored inks of the colors cyan, magenta, and yellow, which are employed to enable color printing.

The maximum width of the mountable tape T in the ink-jet printer 1 of the present embodiment is set at W(max), as shown in FIG. 4. Also, the printable width W(p) of the tape width direction (movement direction of the print head 5) using print head 5 is made to be a range slightly narrower to the right and left than the maximum tape width W(max). Consequently, in the example shown in the Figure, the width of the tape mounted is W1, so the range printable by the print head 5 will have been set to a slightly narrower range W(p1).

The tape width of the mounted tape cartridge 3 can be detected by reading the six display units 38 disposed on the upper surface of the case 31. For example, the tape width dimensions can be displayed by whether holes are opened in each of the display units 38, and the existence or non-existence of holes regarding these display units can be detected by either a mechanical sensor or optical sensor comprising the detecting unit 105*c* on the side of the ink-jet printer.

As shown in FIG. 5, the tape T supplied from the tape cartridge 3 of the present embodiment is of a 3-layered structure with an image-receiving layer 301 on the surface, an adhesive layer 302 on the reverse side thereof, and peeling paper 303 covering the adhesive layer 302 so as to be peeled away. The image-receiving layer 301 on the surface is comprised of an image-receiving portion 312 possessing the image-receiving surface 311 on which actual printing is conducted, and dummy image-receiving portions 313 and 314 possessing dummy image-receiving surfaces 313*a* and 314*a*, which are the same width and are formed on the right and left sides of the above image-receiving portion 312. Slit lines 315 and 316 are formed beforehand at the borderlines between the image-receiving portion 312 and the right and left dummy image-receiving portions 313 and 314. These slit lines 315 and 316 extend from the surface of the dummy portion to the adhesive layer 302 on the reverse side. As a result, it is possible to cut loose the image-receiving portion 312 from the dummy portions to the right and left, and peel away. Further, as shown in the Figure, the width of the image-receiving portion 312 is Wa, while the width of the dummy portions to the right and left 313 and 314 are set at Wb. The width of the tape T generally used is of types such as 6, 9, 12, 18, and 24 mm and the width of the image-receiving surface 311 is set by these values. In this case, a width of 0.5 mm to 5 mm can be used for the dummy image-receiving surfaces 313*a* and 314*a*.

In this way, if there are formed dummy image-receiving surfaces 313*a* and 314*a* on both sides, and if the widths of both are the same at Wb, the total width W1 of the tape T can be given as: Image-receiving surface dimensions Wa (6, 9, 12, 18, or 24 mm, etc.)+2× (Dummy image-receiving surface dimensions Wb) (approximately 0.5 mm to 5 mm). In the case that the dimensions of the dummy left and right image-receiving surfaces are not the same, with the width of one dummy image-receiving surface 313*a* as Wb and the width of the other dummy image-receiving surface 314*a* as Wc, the total width W1 of the tape T can be given as: Wa+Wb+Wc. The dummy image-receiving surface may also be formed on only one side of the image-receiving surface 313 rather than on both sides. In this case, the total width W1 of the tape T becomes the value of either Wa+Wb or Wa+Wc.

Further, for the image-receiving layer 301, a printing sheet of the configuration as disclosed in Japanese Patent Laid-Open No. 4-115984 and Japanese Patent Laid-Open No. 4-115985 may be employed. This printing sheet is of a configuration where, upon a transparent base is formed a layer of mainly pseudo-boehmite generated by hydrolysis of aluminum alkoxide, and upon which is formed a layer comprised mainly of porous silica. The printing sheet of this costruction is appropriate for printing with an ink-jet printer which uses ink containing a high amount of solvent. Of course, image-receiving layers of other structures may be employed, as well.

Figure 6:
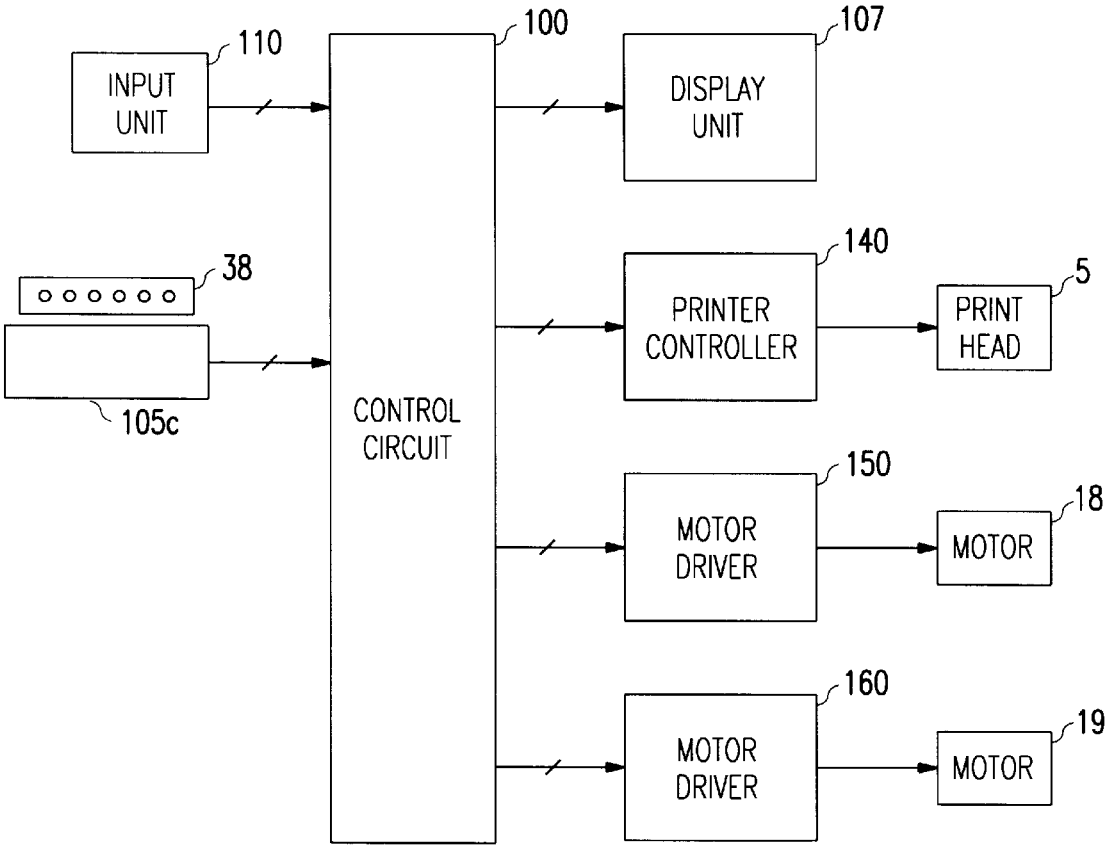
FIG. 6 is a schematic diagram illustrating the control system of the ink-jet printer of FIG. 1.

FIG. 6 illustrates a schematic configuration of the control system of the ink-jet printer 1 of the present embodiment. In the Figure, 100 denotes a control circuit comprised of a micro computer, and to the input side thereof is connected an input unit 110 which is comprised of the key group disposed on the operating panel 102 of the ink-jet printer 1. The detecting unit 105*c* for detecting the tape width is also connected thereto. Connected to the output side of the control circuit 100 are: a display unit 107 such as a liquid crystal display unit for conducting various displays; a printer controller 140 for controlling printing actions of the print head 5; and motor drivers 150 and 160 for drive control of the motors 18 and 19. Based on the control program stored in the ROM of the control circuit 100 beforehand, and under the control of the control circuit 100, a printable range is set according to the width of the tape stored within the mounted tape cartridge 3 and the printing operations such as the latter-mentioned solid printing are conducted.

A printing operation which solidly prints the entire width of tape T by using an ink-jet printer 1 of the present embodiment which has been constructed as above will now be described. As shown in FIG. 5(*c*), the printing range in this case is set so as to be wider than the width Wa of the image-receiving surface 311 of the image-receiving portion 312 which is the tape printing width, and a range W (p1) narrower than the total width W1 of the tape including the width of the dummy image-receiving surfaces 313*a* and 314*a* of the right and left dummy image-receiving portions 313 and 314.

Driving the motor 18 to rotate the tape feeding roller 12 causes the tape T to be delivered from the tape cartridge 3 and to be transported toward the printing position where printing is conducted by means of the print head 5. The lead screw 7 is rotated by the motor 19 synchronously with the transporting action of the tape T, moving the print head 5 with the carriage 6.

As shown in FIG. 5(*c*), the print head 5 is moved in the direction shown by the arrow A in FIG. 5, and printing is started after passing the edge T1 of the tape T which has been transported to the printing position, and from the point T2 which is a point before passing over the dummy image-receiving surface 313*a*. Further, the ending point for the reciprocating action is before passing over the other edge T4 of the tape T, and at the point T3 while passing over the dummy image-receiving surface 314*a*.

After finishing printing, transportation of the tape is continued until the trailing end of the printed image carried upon the tape T reaches the tape cutting position 17. Following this, the tape is temporarily stopped. Here, when the head carriage 6 which carries the print head 5 moves in the direction of the arrow B and returns to the end as shown in FIG. 4, the rotary cutter 61 mounted on the carriage 6 is driven, and the carriage 6 is moved in the direction of the arrows A. As a result, the tape T is ejected out as a piece of tape cut to a certain length, from which, as described above, the image-receiving portion 312 alone can be peeled away and applied to a desired surface. With the present embodiment, slits 315 and 316 are formed so that the image-receiving portion 312 can be peeled away by simply catching the edges of the slits 315 and 316 with one's fingertips.

With the ink-jet printer 1 of the present embodiment, solid printing is conducted from both edges of the image-receiving portion 311 of the tape being transported onto the dummy image-receiving surfaces 313*a* and 314*a* continuing on either side (in a bled manner). Consequently, both edges of the image-receiving surface 311 are in a condition of having received solid printing without any gaps. As a result, a label with solid printing on the edges thereof and without gaps can be obtained by peeling away only the image-receiving portion 312 which possesses the image-receiving surface 311 following printing.

Following this, the roller 12 is rotated in the reverse direction by the motor 18 and the leading end of the tape T is moved back to, for example, a position immediately before the printing position. Also, the carriage 6 moves to the other side wall 22 and presses the projection 182 outward with the side thereof. As a result of this, the link between the motor 18 and the tape feeding roller 12 is broken and the roller 12 stops. The cap mechanism 9 is then driven and the print head 5 becomes capped.

Further, when the lid 105 which covers the mounting portion 23 is opened in order to replace the tape cartridge 3, the tape T, of which leading end is situated before the printing position, is rewound and the leading end returns to the position between the roller 34 and tape guide 33 which define the tape delivering portion of the tape cartridge guide.

Tape T of configurations other than the aforementioned can also be used. A representative example will now be described.

The tape T10 illustrated in FIG. 7 is constructed so that the peeling paper 323 is of a width W1, but the image-receiving layer 321 and adhesive layer 322 thereupon are of a width of Wa, which is narrower than W1. Consequently, with the tape T10 of the present embodiment, dummy image-receiving surfaces 334 and 335 which are equivalent to the dummy image-receiving surfaces 313*a* and 314*a* are formed on the right and left exposed surface portions of the peeling paper 323.

Solid printing is conducted in the same way as above, when using tape T10 as well. The ink droplets ejected by bleeding printing exceeding the width of the image-receiving surface 321*a* of the image-receiving layer 321 are intercepted by the dummy image-receiving surfaces 334 and 335 of the peeling paper 323. It is desirable to have the right and left dummy image-receiving surfaces 334 and 335 formed so as to be able to absorb ink droplets so that these bled ink droplets do not adhere to surrounding portions.

FIG. 8 shows a tape T20 of yet another configuration. The tape T20 of this example is tape which is used conventionally and is of a three-layered structure of an image-receiving layer 341, an adhesive layer 342, and a peeling sheet 343, all of the same width, sequentially layered. In the case of employing this common tape T20, a pair of cutters 356 and 357 for cutting apart the center image-receiving portion 353 which is made to be the image-receiving surface 353*a*, and the dummy portions 354 and 355 which are made to be dummy image-receiving surfaces 354*a* and 355*a*, are disposed, and slits 345 and 346 are applied to the image-receiving layer 341 at a position upstream of the position where the cutter 61 is disposed for cutting the tape.

In this case as well, as described above, a tape of the structure where the dummy image-receiving surface is formed only on one side of the image-receiving surface 353*a* can be used. In the case of using tape on which a dummy image-receiving surface is formed on only one side, instead of providing the pair of cutters 356 and 357 shown in FIG. 8, just one of the cutters 356 or 357 is mounted, and this single cutter is used to cut off the dummy image-receiving surface formed on one side of the tape.

Figure 9:
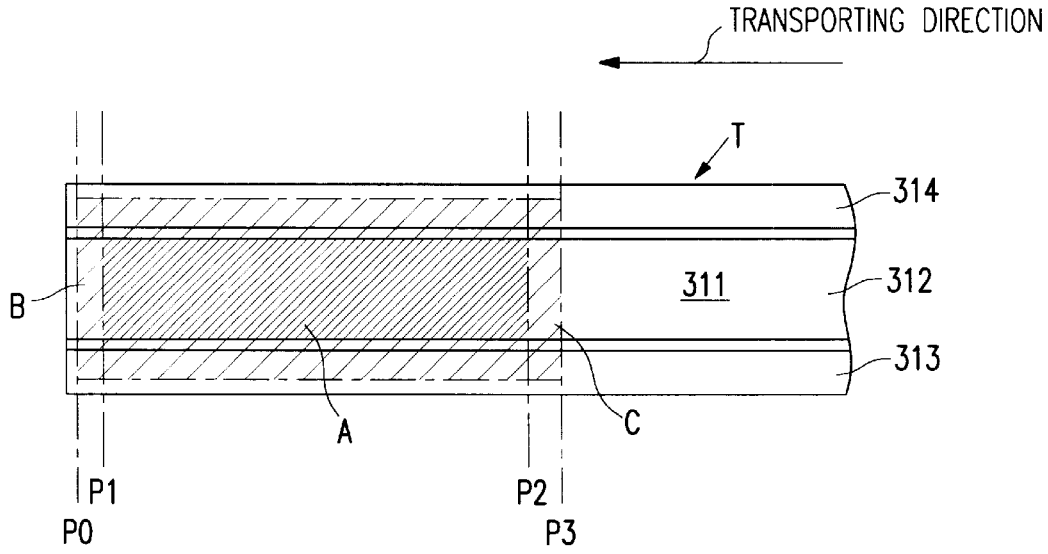
FIG. 9 is an explanatory diagram illustrating the solid printing operation in the longitudinal direction of the tape-shaped printing medium.

Next, an overview of conducting solid printing to the leading and trailing ends in the longitudinal direction of the tape using the ink-jet printer 1 of the present embodiment will be described with reference to FIG. 9.

With the present embodiment, when solid printing in the longitudinal direction of the tape is specified, drive controlling is conducted so that solid printing is begun from a position further downstream in the transporting direction than the actual solid printing starting position P1, printing is started from the printing starting position P0 in the Figure. Further, drive controlling is conducted so that solid printing is continued to a position further downstream in the transporting direction than the actual solid printing finishing position P2 in the Figure, solid printing is continued to the printing finishing position P3.

On the image-receiving surface 311 of the tape T onto which solid printing has been conducted in this manner, in addition to the shaded region A in the Figure which is the target solid printing length, there are located regions of predetermined lengths before and after the region A: solid printing region B on the printing starting side, and solid printing region C on the printing finishing side. These regions are shown by slanted lines. Of course, as mentioned above, with the present embodiment, portions beyond both sides of the image-receiving surface 311 are subjected to solid printing, so this area is shown with slanted lines, as well.

Transportation of the tape T following printing is temporarily stopped when the printing starting position P1 reaches the cutting position 17 at which the printing starting position PI is cut by the rotary cutter 61. The rotary cutter 61 is driven, and the tape T is cut at the solid printing starting position P1. Since this position is further downstream in the transporting direction than the position P0 at which solid printing was actually started, the cutting is conducted at a position which is within the solid printing region. Consequently, the leading end of the cut tape T is in a state of being completely solidly printed, without gaps.

Following this cutting, transportation of the tape T is resumed and continued until the printing finishing position P2 thereof reaches the cutting position. When the position P2 reaches the cutting position, the transporting is temporarily stopped once more, the rotary cutter 61 is driven, and the tape T is cut. Since this cutting position is within the solid printing region as well, the cut edge portion of the cut tape T is in a state of being completely solidly printed, without gaps. Consequently, with a piece of tape of a certain length which has been obtained by cutting leading and trailing ends as above, the leading and trailing ends of the image-receiving surface 311 are in a state of being completely solidly printed, without gaps.

In the above explanation, transportation of the tape T is stopped following solid printing to conduct cutting. However, in the case that the solid printing length is long, and the solid printing length is longer than the distance between the tape printing position and the cutting position, the following method can be employed instead: transporting is controlled so that after solid printing, the tape T is moved backwards and the leading end thereof is cut, following which the tape is moved forward, and the trailing end thereof is cut. Or, printing and transporting can be stopped when the solid printing starting position P1 passes through the cutting position, the tape cut, and then printing and transporting resumed, the tape being moved forward and the trailing end being cut following printing.

Next, with the ink-jet printer 1 of the present invention, the solid printing width at the leading and trailing ends in the longitudinal direction of the tape (the amount of the solid printing portion in the longitudinal direction of the tape) is adjusted as follows. As a printing form, there are cases where a frame is created for solid printing, and inverse white characters are formed therewithin, in which case it is desirable to be able to adjust the width of the solid printing frame.

In view of this point, the present embodiment is configured so that the following 3 modes can be specified by means of key input: wide mode, in which the solid printing width of the leading end in the longitudinal direction of the tape is wide; normal mode, in which the width is normal; and narrow mode, in which the width is narrow.

Figure 10:
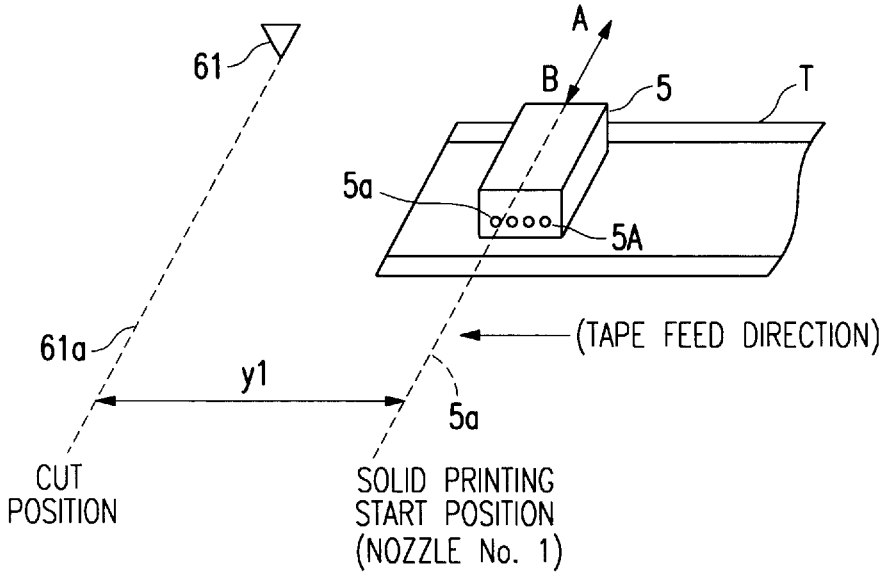
FIG. 10 is an explanatory diagram illustrating the operation for adjusting the width in the longitudinal direction of the tape-shaped printing medium at the solid printing starting portion.
Figure 11:
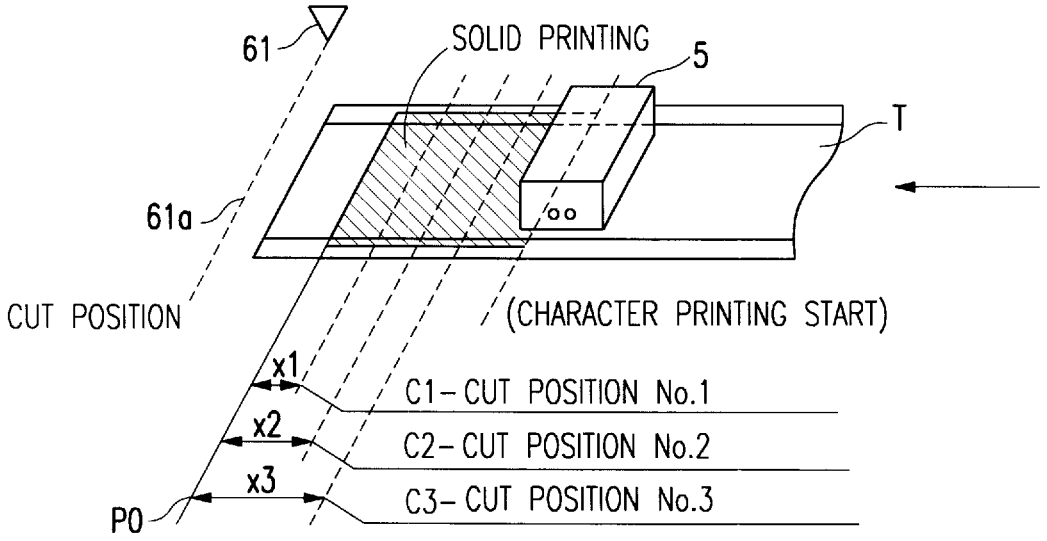
FIG. 11 is an explanatory diagram illustrating the operation for adjusting the width in the longitudinal direction of the tape-shaped printing medium at the solid printing starting portion.

As shown in FIG. 10 of the present embodiment, the distance from nozzle 5*a* which is in the front-most position in the transfer direction of the multiple nozzles 5A arrayed on the print head 5 in the direction of tape transfer, to the cutting position 61*a* of the rotary cutter 61, is y1(m). Further, as shown in FIG. 11, in the case that the wide mode M1 is specified, a position of the distance in the upstream direction of transportation from the starting position P0 of solid printing x1(m) is specified for the cutting position C1. In the case that the normal mode M2 is specified, a position of the distance in the upstream direction of transportation from the starting position P0 of solid printing x2 (>x1) is specified for the cutting position C2. In the case that the narrow mode M3 is specified, a position of the distance in the upstream direction of transportation from the starting position P0 of solid printing x3(>X2) is specified for the cutting position C3. Further, in the present embodiment, the distance y1 is set so as to be sufficiently longer than the distance to the cutting position C3 x3.

In actual practice, the distance to the above cutting positions is controlled by the continuous printing time from the printing starting position, or the transporting time, the distance being measured by the printing speed of the print head 5, i.e., the transport speed of the tape T being v(m/s). In other words, when the wide mode M1 is specified, the tape transporting is temporarily stopped [(y1+x1)/v] seconds after the printing starting point, and the tape T is cut by the rotary cutter 61. In the same way, in the case of normal width mode M2, the tape T is cut [(y1+x2)/v] seconds after the printing starting point, and with narrow mode M3, [(y1+x3)/v] seconds after the printing starting point.

As a result, as shown in FIG. 11, in the wide mode M1, a narrow width of the solid printing portion is cut off, in the narrow mode M3, a wide width of the solid printing portion is cut off, and in the normal mode M2, a portion in between the two above is cut off. In this way, as the portion cut off with the wide mode M1 is small, a wide solid printing frame is obtained at the leading end. In the same way, a normal solid printing frame is obtained at the leading end with normal width mode M2, and a narrow solid printing frame is obtained at the leading end with narrow mode M3.

As described above, with the present embodiment, the width of the leading end of the solid printing can be adjusted by means of controlling the cutting point at which the tape is cut after the solid printing starting position passes through the cutting position.

Next, in the case that the mode is set as described above, the setting is so that the solid printing at the trailing end is the same as well, as described below.

Figure 12:
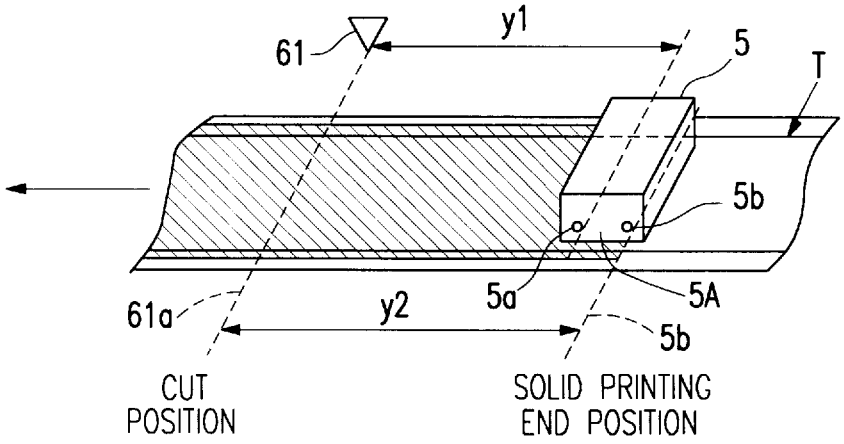
FIG. 12 is an explanatory diagram illustrating the operation for adjusting the width in the longitudinal direction of the tape-shaped printing medium at the solid printing finishing portion.
Figure 13:
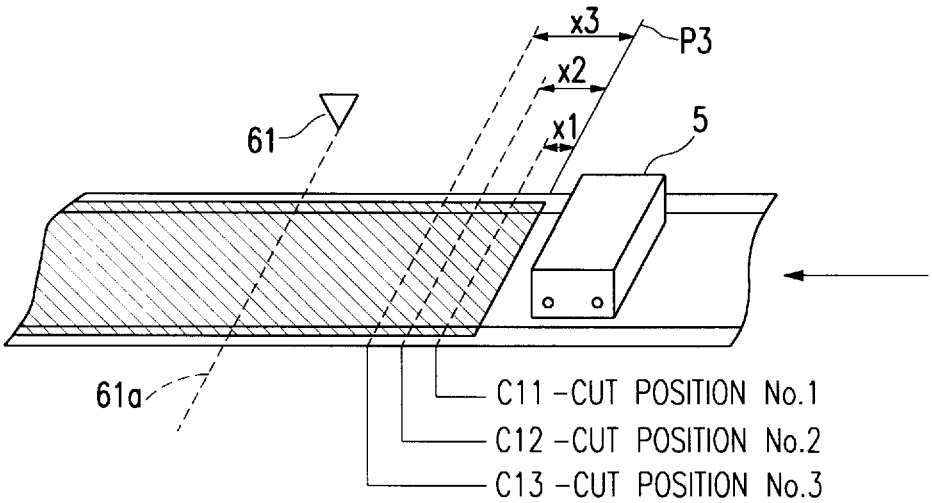
FIG. 13 is an explanatory diagram illustrating the operation for adjusting the width in the longitudinal direction of the tape-shaped printing medium at the solid printing finishing portion.

As shown in FIG. 12 of the present embodiment, the distance from nozzle 5*b* which is in the rearmost position in the transfer direction of the multiple nozzles arrayed on the print head 5 in the direction of tape transfer, to the cutting position 61*a* of the rotary cutter 61, is y2(m). Further, as shown in FIG. 13, in the case that the wide mode M1 is specified, a position of th edistance in the downstream direction of transportation from the finishing position P3 of solid printing x1(m) is specified for the cutting position C11. In the case that the normal mode M2 is specified, a position of the distance in the downstream direction of transportation from the finishing position P3 of solid printing x2 (>x1) is specified for the cutting position C12. In the case that the narrow mode M3 is specified, a position of the distance in the downstream direction of transportation from the finishing position P3 of solid printing x3(>x2) is specified for the cutting position C13. Further, in the present embodiment, the distance y2 is set so as to be sufficiently longer than the distance to the cutting position C3 x3.

In this case as well, the distance to the above cutting positions is controlled by the continuous printing time from the printing starting position, or the transporting time, the distance being measured by the printing speed of the print head 5, i.e., the transport speed of the tape T being v(m/s). In other words, when the wide mode M1 is specified, the tape transporting is temporarily stopped [(y2−x1)/v] seconds after the printing starting point, and the tape T is cut by the rotary cutter 61. In the same way, in the case of normal width mode M2, the tape T is cut [(y2−x2)/v] seconds after the printing starting point, and with narrow mode M3, [(y2−x3)/v] seconds after the printing starting point.

As a result, as shown in FIG. 13, in the wide mode M1, a narrow width of the solid printing portion is cut off, in the narrow mode M3, a wide width of the solid printing portion is cut off, and in the normal mode M2, a portion in between the two above is cut off. In this way, as the portion cut off with the wide mode M1 is small, a wide solid printing frame is obtained at the leading end. In the same way, a normal solid printing frame is obtained at the leading end with normal width mode M2, and a narrow solid printing frame is obtained at the leading end with narrow mode M3.

As described above, with the present embodiment, the width of the leading end of the solid printing can be adjusted by means of controlling the cutting point at which the tape is cut before the solid printing finishing position passes through the cutting position. The leading end of the tape T of which the trailing end is cut as described above retains solid printing portions of the following widths: in wide mode M1, solid printing portion of x1; in normal mode M2, x2, and in narrow mode M3, x3. In the case of subsequently repeating solid printing operations as described above, the amount of reverse movement of the tape T is set as follows: First, in the case that printing has been conducted in the wide mode M1, the amount of backward movement L is set from the following expression:

$$L=y1-x1+x0$$

wherein x0 is a distance which is slightly shorter than x1.

Also, in the case that the normal mode M2 has been specified, the amount of backward movement of the tape is set from the following expression:

$$L=y1-x2+x0$$

In the same way, in the case that the narrow mode M3 has been specified, the amount of backward movement of the tape is set from the following expression:

$$L=y1-x3+x0$$

Figures 14, 15:
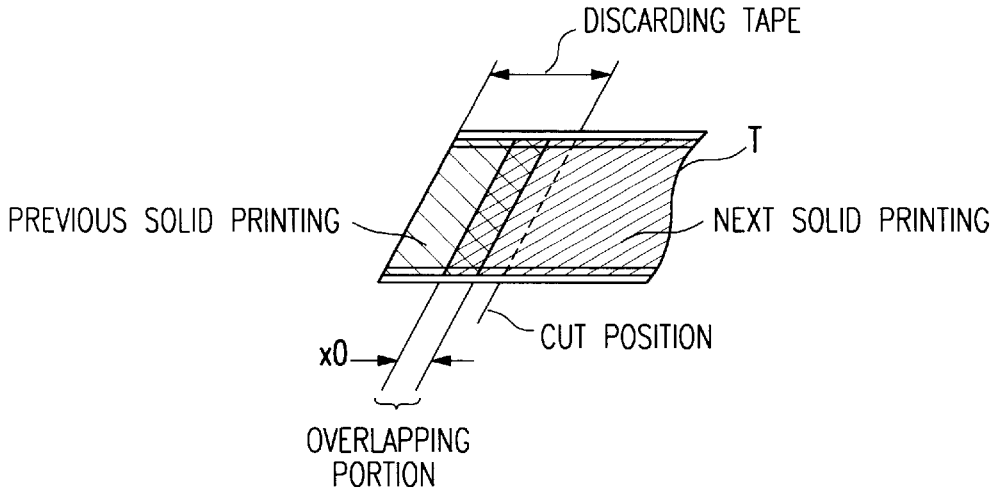
FIG. 14 is an explanatory diagram illustrating the operation for reducing the amount of tape which is cut off and discarded in continuous solid printing operation.
FIG. 15 is a corresponding diagram illustrating the amount by which to move the tape-shape printing medium backwards when setting the various solid printing width modes for the next printing corresponding to the previous solid printing width mode.

As shown in FIG. 14, setting the tape reversal amount in this way results in the next solid printing operation starting in a state of overlapping the previous solid printing portion by the length of x0. Consequently, the amount of tape which is cut away and wasted in the next solid printing operation can be reduced by the length of x0, as compared with the case of starting the next solid printing operation from behind the previous printing finishing end P4. In the case of conducting continuous solid printing action, if the amount by which the tape is moved backwards is determined according to the mode setting of the previous printing operation, the amount of tape which is wasted can be reduced even further.

FIG. 15 lists how the amount of backward movement of the tape is determined according to the previous solid printing operation. In this Figure, x10 is a distance slightly shorter than x1, x20 is a distance slightly shorter than x2, and x30 is a distance slightly shorter than x3. By moving the tape backwards according to the amount shown in this Figure, then starting the next solid printing operation, the benefit of an extremely small amount of tape being cut off of the leading edge and discarded is obtained.

Figure 16:
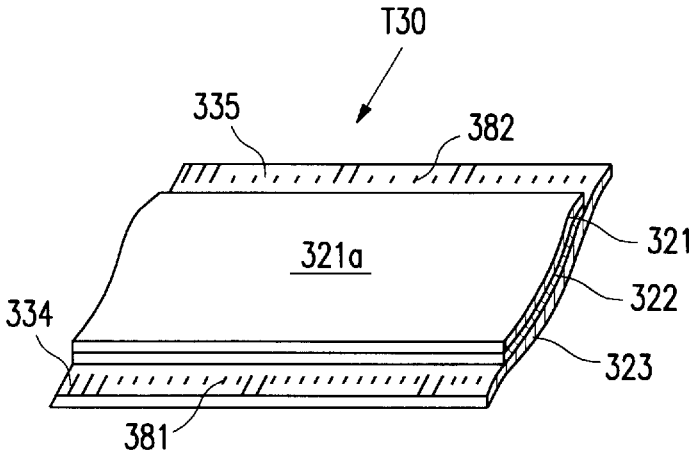
FIG. 16 is a sketch diagram illustrating yet another example of the tape-shaped printing medium.

FIG. 16 shows yet another example of the tape T which can be used with the present embodiment. The basic structure of the tape T30 is the same as the tape T10 shown in FIG. 7. Consequently, the same numerals will be used to denote the same portions as with T10 in FIG. 7, and the descriptions thereof will be omitted. The characterizing point of the tape T30 of the present embodiment is that marks 381 and 382 are formed in the longitudinal direction of the tape at determined intervals upon the dummy image-receiving surfaces 334 and 335 which are on either side.

The benefit of such tape T30 is as follows: In the case that a user has set the solid printing frame width on the leading and trailing ends as described above to a mistaken setting, then formation of a solid printing frame on the leading and trailing ends of a width which is other than that desired results. In such a case, the user can simply cut the leading and trailing ends with scissors or such. However, it is difficult to make a cut which is accurately at a right angle to the longitudinal direction. Further, it is also difficult to make the cuts so that the width of the solid printing frame of the leading and trailing edges become the same. However, with the tape T30 of the present embodiment, marks 381 and 382 are provided thereupon, allowing for usage of these marks as guides for cutting with scissors, etc., enabling accurate cutting of the leading and trailing edges.

Figure 17:
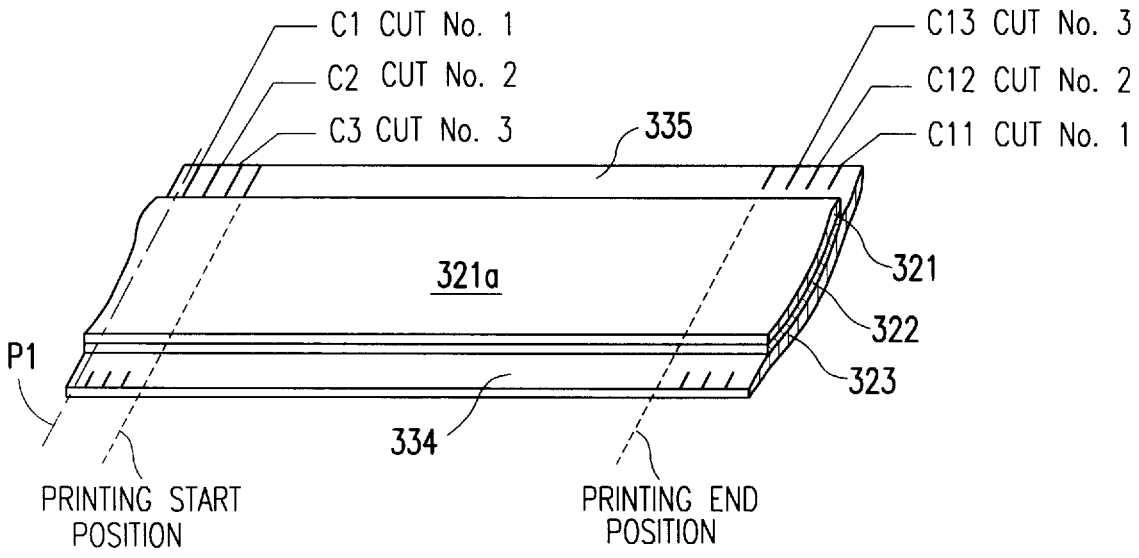
FIG. 17 is a sketch diagram illustrating a piece of tape-shaped printing medium for the purpose of explaining an example of marks to be formed on both edges of the tape-shaped printing medium.

Further, such marks may be made on the tape beforehand or a configuration where the marks are printed with the print head 5 as necessary may be employed, instead. In this case, as shown in FIG. 17, since it is possible for the user to select the width of the leading and trailing solid printing edges, wide, normal, or narrow, it is desirable to print the cutting positions corresponding to these.

In the above description, examples of so-called label tape possessing an adhesive layer and peeling paper on the reverse face thereof were described. However, the present invention can be applied in the same manner in the case of normal tape-shaped recording mediums which posses no adhesive layer nor peeling paper.

As described above, the present invention uses the image-receiving surface of a tape-shaped recording medium of a pre-determined width, a portion thereof which is narrower than the full width is used for the actual image-receiving surface, while the other continuous portions are used as dummy image-receiving surfaces for bleeding. The solid printing action involves solid printing in such a manner that the printing overlaps from the edge of this narrower image-receiving surface onto the outer dummy image-receiving surface portion. Consequently, after solid printing, the unnecessary dummy image-receiving surface portion can be cut loose, thereby obtaining a piece of printed tape-shaped printing medium solidly printed in the longitudinal direction without unprinted gaps at the edges.

Next, the present invention relates to a method of printing upon a tape-shaped printing medium, which is cut to a predetermined length, thereby obtaining a piece of printed tape-shaped printing medium of a certain length, wherein solid printing can be conducted so as to not leave unprinted portions on the leading and trailing ends thereof. To this end, the present invention conducts solid printing from a point before the cutting position and/or to a point beyond the cutting position, then cutting loose the unnecessary leading and trailing solid print portions, thereby obtaining a solidly printed condition formed by cutting without unprinted portions at the leading and trailing ends.

According to this method, the leading and trailing ends of the obtained tape-shaped printing medium are within in the solid printing region which is printed without gaps. Consequently, a piece of tape-shaped printing medium comprised of an image-receiving surface carrying solid printing without unprinted portions on either the leading or trailing ends can be obtained.

Now, according to the present invention, there is the benefit wherein the solid printing frame width formed at the leading and trailing end portions can be changed by controlling the cutting positions of the solid printed tape-shaped printing medium.

Further, according to the method of the present invention, the amount of solid printing which is cut off at the leading and trailing ends is reduced, so that the amount of wasted tape can be reduced.

Also, with the tape-shaped printing medium employed with the present invention, the dummy image-receiving portion for conducting bleeding for solid printing can be easily cut away from the image-receiving portion. Further, that which is provided with marks formed on the dummy image-receiving surface allow for the user to accurately cut the printed tape-shaped printing medium.

What is claimed is:

1. A method of printing upon a tape-shaped printing medium by means of an ink-jet printer, said method comprising:

providing a tape-shaped printing medium including an image-receiving surface of a given width and a dummy image-receiving surface formed on at least one side of said image-receiving surface;

transporting said tape-shaped printing medium along a transport path through a printing position for an ink-jet printing head, conducting solid printing onto said tape-shaped printing medium which passes through said printing position in such a manner that said solid printing overlaps an edge of said image-receiving surface onto said dummy image-receiving surface for solidly printing an edge portion of said image-receiving surface neighboring said dummy image-receiving surface; and cutting said tape-shaped printing medium along a border between said image-receiving surface and said dummy image-receiving surface, thereby obtaining a printed tape-shaped printing medium solidly printed essentially without gaps at least at said edge portion of said dummy image-receiving surface.

2. A method of printing upon a tape-shaped printing medium by means of an ink-jet printer according to claim 1, wherein said tape-shaped printing medium comprises:

an image-receiving layer;

an adhesive layer formed on the reverse face of said image-receiving layer; and a peeling paper layer covering said adhesive layer wherein the surface of said tape is comprised of said image-receiving surface and said dummy imagine-receiving surface.

3. A method of printing upon a tape-shaped printing medium by means of an ink-jet printer according to claim 2, wherein said tape-shaped printing medium is constructed so that said dummy image-receiving surface is formed on either side of said image-receiving surface of said tape-shaped printing medium.

4. A method of printing upon a tape-shaped printing medium by means of an ink-jet printer according to claim 2, wherein the border between said image-receiving surface and said dummy image-receiving surface includes a slit for enabling a portion of said image-receiving layer upon which said image-receiving surface is formed to be cut from said portion of said image-receiving layer whereupon said dummy image-receiving surface is formed for allowing peeling thereof from said peeling paper.

5. A method of solid printing upon a tape-shaped printing medium according to claim 2, wherein a cutting blade is employed to cut the tape-shaped printing medium which has been printed upon, said cutting conducted along the border between said image-receiving surface and said dummy image-receiving surface.

6. A method of solid printing upon a tape-shaped printing medium according to claim 5, wherein said cutting blade is located downstream from the printing position for cutting the tape-shaped printing medium which has been printed upon, said cutting being conducted along the border between said image-receiving surface and said dummy image-receiving surface.

7. A method of printing upon a tape-shaped printing medium by means of an ink-jet printer according to claim 2, wherein said dummy image-receiving surface is provided with marks at predetermined intervals along the longitudinal direction thereof.

8. A method of printing upon a tape-shaped printing medium by means of an ink-jet printer according to claim 2, wherein said dummy image-receiving surface is printed with marks at predetermined intervals along the longitudinal direction thereof.

9. A method of printing upon a tape-shaped printing medium by means of an ink-jet printer according to claim 1, wherein said tape-shaped recording medium is comprised of:

an image-receiving layer including an image-receiving surface;

an adhesive layer formed on the reverse face of said image-receiving layer; and a peeling paper covering said adhesive layer wherein the face of said peeling paper which faces said adhesive layer is provided with an exposed surface whereupon there is no deposition of said image-receiving layer nor said adhesive layer, said exposed surface comprising said dummy image-receiving surface.

10. A method of printing upon a tape-shaped printing medium by means of an ink-jet printer according to claim 9, wherein said exposed surface is formed on either side of said peeling paper of said tape-shaped printing medium, said exposed surface comprising said dummy image-receiving surface.

11. A method of printing upon a tape-shaped printing medium by means of an ink-jet printer according to claim 9, wherein said dummy image-receiving surface is provided with marks at predetermined intervals along the longitudinal direction thereof.

12. A method of printing upon a tape-shaped printing medium by means of an ink-jet printer according to claim 9, wherein said dummy image-receiving surface is printed with marks at predetermined intervals along the longitudinal direction thereof.

13. A method of printing upon a tape-shaped printing medium by means of an ink-jet printer, said method comprising:

providing a tape-shaped printing medium including an image-receiving surface of a given width;

transporting said tape-shaped printing medium along a transport path through a printing position for an ink-jet head;

conducting solid printing of a predetermined length onto said tape-shaped printing medium which passes through said printing position; and cutting the tape-shaped printing medium of which printing has been completed either upstream from a printing starting position or downstream from a printing finishing position for obtaining a portion of printed tape-shaped printing medium of a certain length solidly printed essentially without gaps at least at an edge of said cut portion.

14. A method of printing upon a tape-shaped printing medium by means of an ink-jet printer according to claim 13, wherein the cutting position of the tape-shaped printing medium is located downstream from said printing starting position, and wherein said tape-shaped printing medium is temporarily stopped and cut after the printing starting position has passed through said cutting position, and further wherein a stopping position of the tape-shaped printing medium is controlled for the purpose of this cutting, thereby permitting adjustment of the solid printing of the tape-shaped printing medium at the printing starting position.

15. A method of printing upon a tape-shaped printing medium by means of an ink-jet printer according to claim 13, wherein said tape-shaped printing medium is temporarily stopped and cut before the printing starting position passes through said cutting position, and wherein a stopping position of the tape-shaped printing medium is controlled for the purpose of this cutting, thereby permitting adjustment of the solid printing of the tape-shaped printing medium at the printing finishing position.

16. A method of printing upon a tape-shaped printing medium by means of an ink-jet printer according to claim 15, wherein following cutting of said tape-shaped printing medium at the finishing position, said tape-shaped printing medium is moved backwards, and having thereby positioned said printing position of said ink-jet head within the solid printing portion remaining from a previous solid printing on a leading end of said tape-shaped printing medium, new solid printing action is initiated so as to overlap said previous printing.

17. A method of solid printing upon a tape-shaped printing medium according to claim 16, wherein the backwards movement of said tape-shaped printing medium is adjusted according to the amount of the solid printing portion remaining in the longitudinal direction from the previous solid printing on the leading end of said tape-shaped printing medium.

18. A method of printing upon a tape-shaped printing medium by means of an ink-jet printer according to claim 13, wherein the cutting position of said tape-shaped printing medium is located downstream from said printing position, and wherein said tape-shaped printing medium is temporarily stopped and cut before the printing starting position passes through said cutting position, and further wherein a stopping position of the tape-shaped printing medium is controlled for the purpose of this cutting, thereby permitting adjustment of the solid printing of the tape-shaped printing medium at the printing finishing position.

19. A method of printing upon a tape-shaped printing medium by means of an ink-jet printer according to claim 13, wherein said tape-shaped printing medium includes an image-receiving surface of a given width and a dummy image-receiving surface of a predetermined width formed on at least one side of said image-receiving surface, and wherein said dummy image-receiving surface is printed with marks at predetermined intervals along the longitudinal direction thereof.

20. A tape-shaped printing medium with an image-receiving surface of a certain width and a dummy image-receiving surface of a predetermined width formed on at least one side of said image-receiving surface comprising:

an image receiving layer including said image-receiving surface and said dummy image-receiving surface;

an adhesive layer formed on the reverse face of said image-receiving layer; and a peeling paper layer covering said adhesive layer.

21. A tape-shaped printing medium according to claim 20, wherein said tape-shaped printing medium is constructed so that said dummy image-receiving surface is formed on either side of said image-receiving surface of said tape-shaped printing medium.

22. A tape-shaped printing medium according to claim 20, wherein a border between said image-receiving surface and said dummy image-receiving surface is provided with a slit.

23. A tape-shaped printing medium according to claim 20, wherein said dummy image-receiving surface is provided with marks at predetermined intervals along a longitudinal direction thereof.

24. A tape-shaped printing medium with an image-receiving surface of a certain width and a dummy image-receiving surface of a predetermined width formed on at least one side of said image-receiving surface comprised of:

an image-receiving layer including an image-receiving surface;

an adhesive layer formed on the reverse face of said image-receiving layer; and a peeling paper covering said adhesive layer wherein the face of said peeling paper which faces said adhesive layer is provided with an exposed surface whereupon there is no deposition of said image-receiving layer nor said adhesive layer, said exposed surface comprising said dummy image-receiving surface.

25. A tape-shaped printing medium according to claim 24, wherein said exposed surface is formed on either side of said peeling paper of said tape-shaped printing medium, said exposed surface comprising said dummy image-receiving surface.

26. A tape-shaped printing medium according to claim 24, wherein said dummy image-receiving surface is provided with marks at predetermined intervals along the longitudinal direction thereof.

27. A method of printing upon a tape-shaped printing medium by means of an ink-jet printer according to claim 1, wherein said solid printing is of a predetermined length in the longitudinal direction of the tape-shaped printing medium which passes through said printing position, and wherein the tape-shaped printing medium of which printing has been completed is cut either upstream from a printing starting position or downstream from a printing finishing position, thereby obtaining a portion of printed tape-shaped printing medium of a certain length solidly printed in a longitudinal direction essentially without gaps at an edge of said cut portion.

28. A method of printing upon a tape-shaped printing medium by means of an ink-jet printer according to claim 27, wherein said tape-shaped printing medium comprises:

an image-receiving layer including an image-receiving surface and dummy image receiving surface;

an adhesive layer formed on the reverse face of said image-receiving layer; and a peeling paper covering said adhesive layer.

29. A method of printing upon a tape-shaped printing medium by means of an ink-jet printer according to claim 28, wherein said dummy image-receiving surface is formed on either side of said tape-shaped printing medium.

30. A method of printing upon a tape-shaped printing medium by means of an ink-jet printer according to claim 28, wherein the border between said image-receiving surface and said dummy image-receiving surface of said tape-shaped printing medium is provided with a slit, thereby enabling the portion of said image-receiving layer upon which said image-receiving surface is formed to be cut from the portion of said image-receiving layer whereupon said dummy image-receiving surface is formed for allowing peeling thereof from said peeling paper.

31. A method of solid printing upon a tape-shaped printing medium according to claim 28, wherein a pair of cutting blades are provided downstream from said printing starting position to cut the tape-shaped printing medium which has been printed upon, along the border between said image-receiving surface and said dummy image-receiving surface.

32. A method of printing upon a tape-shaped printing medium by means of an ink-jet printer according to claim 28, wherein said dummy image-receiving surface is provided with marks at predetermined intervals along the longitudinal direction thereof.

33. A method of printing upon a tape-shaped printing medium by means of an ink-jet printer according to claim 28, wherein said dummy image-receiving surface is printed with marks at predetermined intervals along the longitudinal direction thereof.

34. A method of printing upon a tape-shaped printing medium by means of an ink-jet printer according to claim 27, wherein said tape-shaped recording medium comprises:

an image-receiving layer which includes an image-receiving surface;

an adhesive layer formed on the reverse face of said image-receiving layer; and a peeling paper covering said adhesive layer wherein the face of said peeling paper which faces said adhesive layer is provided with a formation of a exposed surface whereupon there is no deposition of said image-receiving layer nor said adhesive layer, said exposed surface comprising said dummy image-receiving surface.

35. A method of printing upon a tape-shaped printing medium by means of an ink-jet printer according to claim 34, wherein said exposed surface is formed on either side of said peeling paper of said tape-shaped printing medium, said exposed surface comprising said dummy image-receiving surface.

36. A method of printing upon a tape-shaped printing medium by means of an ink-jet printer according to claim 34, wherein said dummy image-receiving surface is provided with marks at predetermined intervals along the longitudinal direction thereof.

37. A method of printing upon a tape-shaped printing medium by means of an ink-jet printer according to claim 34, wherein said dummy image-receiving surface is printed with marks at predetermined intervals along the longitudinal direction thereof.

38. A method of printing upon a tape-shaped printing medium by means of an ink-jet printer according to claim 28, wherein a cutting position of the said tape-shaped printing medium is located downstream from said printing starting position, and wherein said tape-shaped printing medium is temporarily stopped and cut after the printing starting position has passed through said cutting position, and further wherein a stopping position of the tape-shaped printing medium is controlled for the purpose of this cutting, thereby permitting adjustment of the solid printing of the tape-shaped printing medium at the printing starting position.

39. A method of printing upon a tape-shaped printing medium by means of an ink-jet printer according to claim 28, wherein said tape-shaped printing medium is temporarily stopped and cut before the printing starting position passes through said cutting position, and wherein a stopping position of the tape-shaped printing medium is controlled for the purpose of this cutting, thereby permitting adjustment of the solid printing of the tape-shaped printing medium at the printing finishing position.

40. A method of printing upon a tape-shaped printing medium by means of an ink-jet printer according to claim 39, wherein following cutting of said tape-shaped printing medium at the finishing position, said tape-shaped printing medium is moved backwards, and having thereby positioned said printing position of said ink-jet head within the solid printing portion remaining from a previous solid printing on a leading end of said tape-shaped printing medium, new solid printing action is initiated so as to overlap said previous solid printing.

41. A method of solid printing upon a tape-shaped printing medium according to claim 40, wherein the backwards movement of said tape-shaped printing medium is adjusted according to the amount of the solid printing portion remaining in the longitudinal direction from the previous solid printing on the leading end of said tape-shaped printing medium.

42. A method of printing upon a tape-shaped printing medium by means of an ink-jet printer according to claim 28, wherein the cutting position of said tape-shaped printing medium is located downstream from said printing position, and wherein said tape-shaped printing medium is temporarily stopped and cut before the printing starting position passes through said cutting position, and further wherein a stopping position of the tape-shaped printing medium is controlled for the purpose of this cutting, thereby permitting adjustment of the solid printing of the tape-shaped printing medium at the printing finishing position.

43. A method of printing upon a tape-shaped printing medium by means of an ink-jet printer according to claim 28, wherein said tape-shaped printing medium includes an image-receiving surface of a given width and a dummy image-receiving surface of a predetermined width formed on at least one side of said image-receiving surface, and wherein said dummy image-receiving surface is printed with marks at predetermined intervals along the longitudinal direction thereof.

44. A method for printing on a print medium comprising the steps of:

providing a print medium including a first image receiving surface and a second image receiving surface;

printing said print medium so as to form an essentially solid coating across a border between said first image receiving surface and said second image receiving surface; and cutting said print medium along said border.

45. The method of claim 44 wherein the border includes a perforation.

46. A print medium comprising:

a first layer including a first image receiving surface and at least a second image receiving surface;

a second layer of adhesive formed on a face of said first layer; and a third layer peelably secured to said second layer.

47. A print medium comprising:

a first layer including a first image receiving surface;

a second layer of adhesive formed on a face of said first layer; and a third layer peelably secured to said second layer including a second image receiving surface.

48. The print medium of claim 47 wherein said second image receiving surface extends beyond at least an edge of said first and second layers.

49. A method for printing on a print medium comprising the steps of:

providing a print medium including a first image receiving surface and a second image receiving surface;

printing said print medium so as to form an essentially solid coating across a border between said first image receiving surface and said second image receiving surface; and cutting said print medium laterally so as to provide a piece of said print medium.

50. The method of claim 49 further comprising the step of repositioning said print medium prior to said cutting so that said cutting is performed in a printed region of said print medium.

51. The method of claim 50 wherein said repositioning is performed according to an amount of said printed region desired to be used.

52. The method of claim 49 further comprising the step of cutting said print medium along said border.

* * * * *